US010274248B2

(12) United States Patent
L V et al.

(10) Patent No.: US 10,274,248 B2
(45) Date of Patent: Apr. 30, 2019

(54) REFRIGERATION APPLIANCE

(71) Applicant: BSH HAUSGERAETE GMBH, Munich (DE)

(72) Inventors: Ping L V, Nanjing (CN); Yaoguo Xu, Nanjing (CN); Chuan Zhang, Chuzhou (CN)

(73) Assignee: BSH Hausgeraete GmbH, Munich (DE)

( * ) Notice: Subject to any disclaimer, the term of this patent is extended or adjusted under 35 U.S.C. 154(b) by 0 days.

(21) Appl. No.: 15/856,283

(22) Filed: Dec. 28, 2017

(65) Prior Publication Data

US 2018/0187959 A1 Jul. 5, 2018

(30) Foreign Application Priority Data

Dec. 29, 2016 (CN) ..... 2016 1 1253599

(51) Int. Cl.
*A47F 3/04* (2006.01)
*F25D 23/02* (2006.01)
*F25D 23/06* (2006.01)

(52) U.S. Cl.
CPC ..... *F25D 23/065* (2013.01); *A47F 3/0434* (2013.01); *F25D 23/028* (2013.01)

(58) Field of Classification Search
CPC ..... F25D 23/02; F25D 23/025; F25D 23/028; F25D 2323/023
See application file for complete search history.

(56) References Cited

U.S. PATENT DOCUMENTS 2,150,064 A * 3/1939 John ..... F25D 23/04 292/169
2011/0089790 A1* 4/2011 Lee ..... B29C 44/1233 312/109
2013/0134854 A1* 5/2013 You ..... F25D 23/028 312/405
2014/0132143 A1* 5/2014 Kim ..... F25D 23/028 312/405
2014/0132146 A1* 5/2014 Kim ..... F25D 23/025 312/405.1
2016/0238302 A1* 8/2016 Yang ..... F25D 17/06
2017/0122649 A1* 5/2017 Im ..... F25B 39/00
2017/0191741 A1* 7/2017 Jung ..... F25D 23/04
2017/0211874 A1* 7/2017 Kim ..... F25D 23/025
2018/0164031 A1* 6/2018 Lee ..... F25D 23/02

* cited by examiner

*Primary Examiner* — Daniel J Rohrhoff
(74) *Attorney, Agent, or Firm* — Laurence A. Greenberg; Werner H. Stemer; Ralph E. Locher

(57) ABSTRACT

A refrigeration appliance includes a case body and a door connected to the case body. The door includes a doorframe, a container connected to the back of the doorframe, and a foamed heat insulation material located between the doorframe and the container. The door has a through hole that extends in a front-to-rear direction. The doorframe has a first wall facing the through hole. The container has a second wall facing the through hole. The first wall and the second wall are superposed and clamped to form an inner wall of the through hole. This solution can avoid displacement between the doorframe and the container, thereby avoiding foam leakage.

12 Claims, 3 Drawing Sheets

REFRIGERATION APPLIANCE

CROSS-REFERENCE TO RELATED APPLICATION

This application claims the benefit, under 35 U.S.C. § 119, of Chinese patent application CN 201611253599.5 filed Dec. 29, 2016; the prior application is herewith incorporated by reference in its entirety.

BACKGROUND

Technical Field

The present invention relates to a refrigeration appliance.

Related Art

A storage space of an existing refrigeration appliance such as a refrigerator may be closed by using a single-layer door, or may be closed by using a double-layer door including an inner door and an outer door. For a double-layer door, an inner door of the double-layer door includes a doorframe having a through hole and a container connected to the doorframe. In some existing products, an assembly structure between a container and a doorframe is excessively simple, and the container is easily displaced. Consequently, on one hand, foam leakage occurs during foaming, and on the other hand, a gap between the container and the doorframe grows after foaming.

BRIEF SUMMARY OF THE INVENTION

The present invention provides an improved refrigeration appliance, to resolve at least one of the foregoing technical problems.

To resolve the foregoing problems, the present invention provides a refrigeration appliance, including a case body and a door connected to the case body, where the door includes a doorframe, a container connected to the back of the doorframe, and a foamed heat insulation material located between the doorframe and the container, and the door has a through hole that extends in a front-to-rear direction; the doorframe has a first wall facing the through hole, the container has a second wall facing the through hole, and the first wall and the second wall are superposed and clamped to form an inner wall of the through hole.

Compared with the prior art, the technical solution of the present invention has the following advantage: the doorframe and the container are superposed and clamped with each other by means of the respective first wall and second wall facing the through hole; after the first wall is clamped with the second wall, locations of the doorframe and the container are relatively determined, and movement does not easily occur, to avoid displacement between the doorframe and the container, so as to avoid foam leakage during foaming, thereby ensuring that a gap between the container and the doorframe does not grow after foaming.

In some embodiments, the first wall and the second wall are clamped by using clamping hooks hooked with each other. In some other embodiments, the first wall is clamped with the second wall by using a clamping slot and a clamping block disposed in the clamping slot.

Optionally, a surface on which the clamping hooks that are hooked with each other are hooked with each other is a flat surface. Preferably, a cross section of the clamping hook is a triangle, to facilitate installation.

Optionally, the first wall is provided with a clamping slot in front of the clamping hook, to accommodate the clamping hook of the second wall.

Optionally, the first wall is provided with a shoulder facing a free end of the second wall, and the free end abuts against the shoulder.

Optionally, the doorframe further includes a groove whose opening faces the container, and a sealing member for sealing between the doorframe and the container is clamped in the groove. One part of the sealing member is clamped in the groove, and the other part of the sealing member extends out of the groove. The part, extending out of the groove, of the sealing member has a concave surface facing the container. The concave surface deforms upon a mutual pressing effect between surfaces, facing each other, of the container and the doorframe, to be tightly attached on a corresponding surface of the container.

Optionally, the doorframe is provided with the groove on each edge of the through hole.

Optionally, the grooves, on the edges of the through hole, of the doorframe are connected end to end to form an annular shape surrounding the through hole. Correspondingly, the sealing members may be a plurality of seal strips connected end to end surrounding the through hole, or may be an integral annular member to match the grooves.

Optionally, along a length or width direction of the door, the groove is closer to an edge of the door than the first wall. In other words, an annular shape where an inner wall of the through hole is located is located within the annular shape where the grooves and the sealing members are located.

Optionally, a case body is further included, and the door is rotatably connected to the case body; and an outer door rotatably connected to the door is further included, to close the through hole of the door.

Other features which are considered as characteristic for the invention are set forth in the appended claims.

Although the invention is illustrated and described herein as embodied in a refrigeration appliance, it is nevertheless not intended to be limited to the details shown, since various modifications and structural changes may be made therein without departing from the spirit of the invention and within the scope and range of equivalents of the claims.

DETAILED DESCRIPTION

To make the foregoing objective, features, and advantages of the present invention more comprehensible, specific embodiments of the present invention are described in detail below with reference to the accompanying drawings.

The embodiments of the present invention provide a refrigeration appliance. The refrigeration appliance may be a refrigerator, but is not limited to a refrigerator, and may alternatively be another electric appliance having a storage space closed by using a door.

Figure 1:
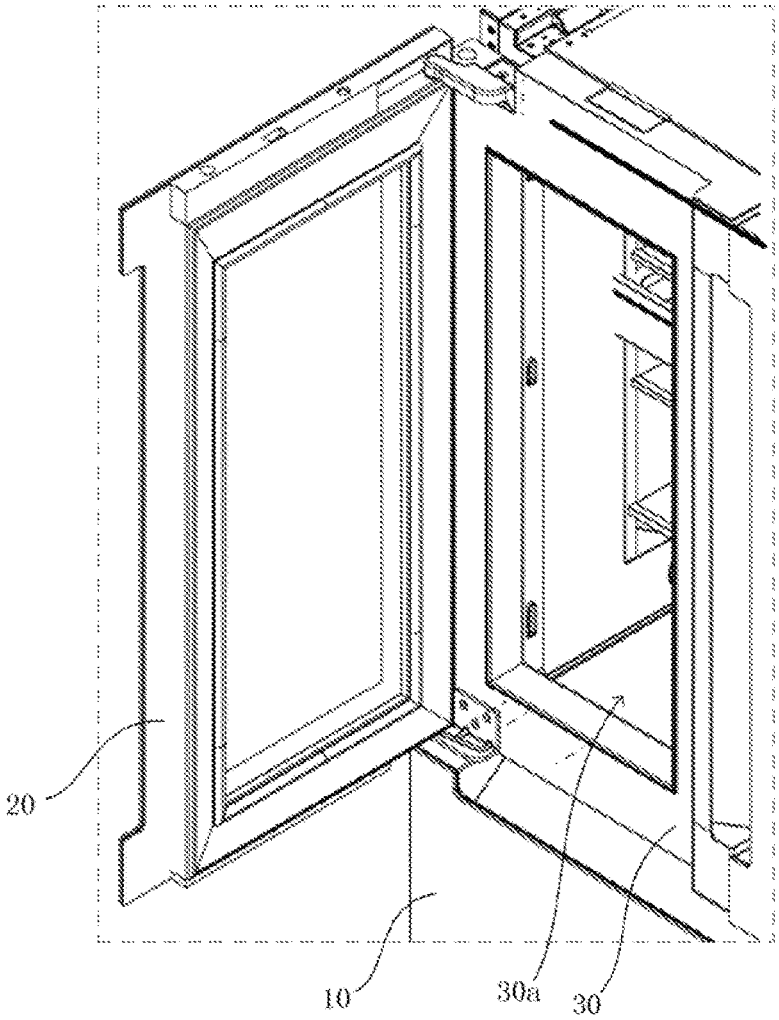
FIG. 1 is a partial schematic three-dimensional view of a refrigeration appliance according to an embodiment of the present invention, and shows a door structure.

Referring to FIG. 1, the refrigeration appliance includes a case body 10 and a door structure connected to the case body 10. The door structure is a double-layer door, and includes an outer door 20 and an inner door 30 located between the outer door 20 and the case body 10. The outer door 20 and the inner door 30 may separately rotate relative to the case body 10. The outer door 20 may also rotate relative to the inner door 30. During door opening, the outer door 20 may be separately opened, or the outer door 20 and the inner door 30 may be opened together.

The outer door 20 may be a glass door or a foamed door. The inner door 30 is a foamed door and has a through hole 30*a* that extends in a front-to-rear direction.

The following mainly describes the structure of the inner door 30 in detail.

Figure 2:
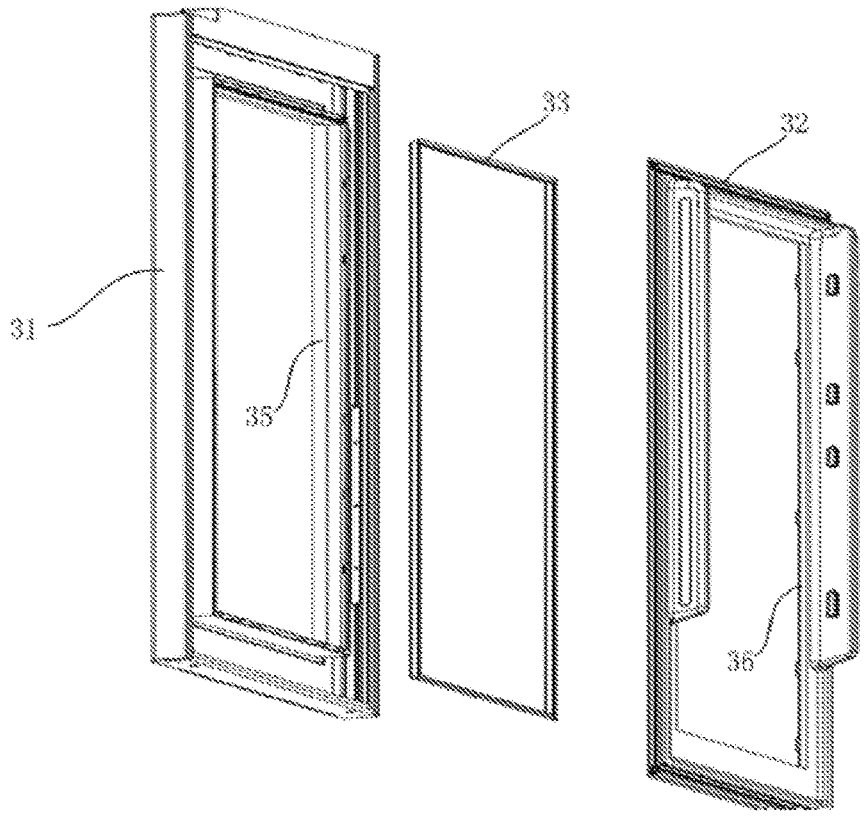
FIG. 2 is a schematic three-dimensional exploded view of an inner door of the refrigeration appliance according to this embodiment of the present invention.

Referring to FIG. 2, the inner door 30 includes a doorframe 31, a container 32 connected to the back of the doorframe 31, and a foamed heat insulation material (not shown in the figure) located between the doorframe 31 and the container 32. The through hole 30*a* penetrates through the doorframe 31 and the container 32. The through hole 30*a* may be used as a storage space of the inner door 30 to accommodate objects. When the outer door 20 is closed, the through hole 30*a* is covered by the outer door 20.

Figure 3:
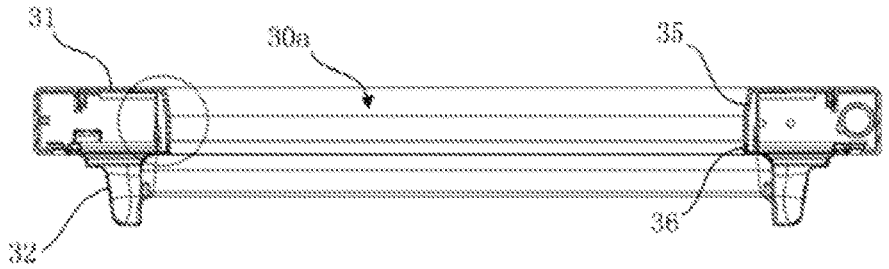
FIG. 3 is a schematic cross-sectional view of the inner door of the refrigeration appliance according to this embodiment of the present invention.

As shown in FIG. 2 in combination with FIG. 3, the doorframe 31 has a first wall 35 facing the through hole 30*a*, the container 32 has a second wall 36 facing the through hole 30*a*, and the first wall 35 and the second wall 36 are superposed and clamped to form an inner wall of the through hole 30*a*.

There may be a plurality of ways to clamp the first wall 35 with the second wall 36. For example, the first wall 35 is clamped with the second wall 36 by means of hooking a clamping hook with another clamping hook, or by means of clamping a clamping slot with a clamping block.

The advantage of this solution is that the doorframe and the container are superposed and clamped with each other by means of the respective first wall and second wall facing the through hole; after the first wall is clamped with the second wall, locations of the doorframe and the container are relatively determined, and movement does not easily occur, to avoid displacement between the doorframe and the container, so as to avoid foam leakage during foaming, thereby ensuring that a gap between the container and the doorframe does not grow after foaming.

Figure 4:
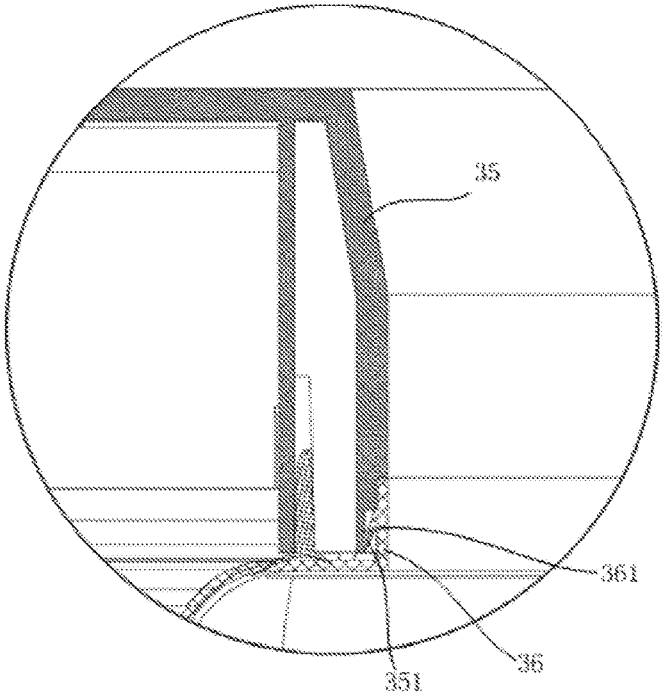
FIG. 4 is an enlarged view of a circled part in FIG. 3.
Figure 5:
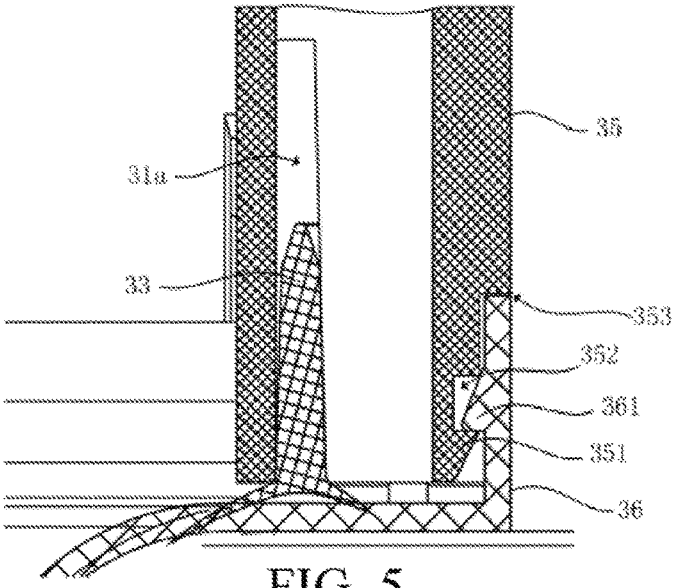
FIG. 5 is an enlarged view of the inner door when the inner door is at locations of clamping hooks that are hooked with each other and a sealing member.

In this embodiment, as shown in FIG. 4 in combination with FIG. 5, the first wall 35 and the second wall 36 are clamped by using clamping hooks hooked with each other. A clamping hook of the first wall 35 is defined as a first clamping hook 351, and a clamping hook on the second wall 36 is defined as a second clamping hook 361. The first clamping hook 351 and the second clamping hook 361 are hooked with each other.

When the first clamping hook 351 is hooked with the second clamping hook 361, there may be line contact or surface contact between the first clamping hook 351 and the second clamping hook 361. As shown in FIG. 5, when the first clamping hook 351 and the second clamping hook 361 of this embodiment are hooked with each other, a surface on which the first clamping hook 351 and the second clamping hook 361 are in surface contact with each other and are hooked with each other is a flat surface.

During installation, the doorframe 31 and the container 32 move towards each other along a front-to-rear direction of the door, to insert the second wall 36 into a ring enclosed by the first wall 35. Moreover, the first clamping hook 351 is clamped with the second clamping hook 361. Preferably, a cross section of each clamping hook is a triangle, and in particular, a right triangle.

Further, along the front-to-rear direction of the door, the first wall 35 is provided with a clamping slot 352 in front of the first clamping hook 351, to accommodate the second clamping hook 361 of the second wall 36.

As shown in FIG. 5, the first wall 35 is provided with a shoulder 353 facing a free end of the second wall 36. The free end (that is, a front end facing the door) of the second wall 36 abuts against the shoulder 353. In addition, a surface, facing the side of the through hole 30*a*, of the second wall 36 is flush to a surface, exposed in the through hole 30*a*, of the first wall 35. The width of the shoulder 353 is approximately consistent with the thickness of the second wall 36. The width of the shoulder 353 and the thickness of the second wall 36 are both the size in the left-to-right direction in FIG. 5.

In some other embodiments, the width of the shoulder 353 may alternatively be greater than the thickness of the second wall 36. For example, the size of the clamping slot 352 along a front-to-rear direction may be enlarged, and the clamping slot 352 may be extended to the free end of the second wall 36, so as to use a side wall, located in front along the front-to-rear direction, of the clamping slot 352 as the shoulder 353.

As shown in FIG. 4 and FIG. 5, the doorframe 31 further includes a groove 31*a* whose opening faces the container 32. Along a length or width direction of the door, the groove 31*a* is closer to an edge of the inner door 30 than the first wall 35, that is, farther from the through hole 30*a*. A sealing member 33 for sealing between the doorframe 31 and the container 32 is clamped in the groove 31*a*. As shown in FIG. 5, one part of the sealing member 33 is clamped in the groove 31*a*, and the other part of the sealing member 33 extends out of the groove 31*a*. When the doorframe 31 is assembled with the container 32, the sealing member 33 is clamped between surfaces, facing each other, of the doorframe 31 and the container 32, to seal a gap therebetween, implementing a sealing function.

A cross section of the part, extending out of the groove 31*a*, of the sealing member 33 may have an concave surface facing the container 32, so that during assembly, the concave surface is pressed when the surfaces, facing each other, of the container 32 and the doorframe 31 move towards each other, making the concave surface tightly attached to the container 32.

It should be understood that, to achieve a good sealing effect, the doorframe 31 is provided with the groove 31*a* on each edge of the through hole 30*a*. The sealing member 33 is correspondingly disposed in each groove 31*a*, and the length of the sealing member 33 is approximately consistent with the length of the groove 31*a*.

To ensure sealing between the doorframe 31 and the container 32 at each location of the periphery of the through hole 30*a*, the grooves 31*a*, on the edges of the through hole 30*a*, of the doorframe 31 are connected end to end to form an annular shape surrounding the through hole 30*a*. Correspondingly, the sealing members 33 are also connected end to end along the edges of the through hole 30*a*, to form an annular shape surrounding the through hole 30*a*. Alternatively, as shown in FIG. 3, the sealing members 33 may be a plurality of seal strips connected end to end surrounding the through hole 30*a*, or may be an integral annular member and clamped into the grooves 31*a*.

Although the present invention is disclosed as above, the present invention is not limited thereto. Any person skilled in the art can make various variations and modifications without departing from the spirit and scope of the present invention, and therefore the protection scope of the present invention is subject to the appended claims.

The invention claimed is:

1. A refrigeration appliance, comprising:

a case body and a door connected to the case body;

the door having a doorframe, a container connected to the back of the doorframe, and a foamed heat insulation material between the doorframe and the container;

the door being formed with a through hole that extends in a front-to-rear direction;

the doorframe having a first wall facing the through hole, the container having a second wall facing the through hole, and the first wall and the second wall being superposed and clamped to form an inner wall of the through hole, the first wall and the second wall defining adjacent surfaces of the through hole in the front-to-rear direction, the adjacent surfaces delimiting the through hole.

2. The refrigeration appliance according to claim 1, wherein the first wall and the second wall are clamped by way of a first wall clamping hook hooked with a second wall clamping hook.

3. The refrigeration appliance according to claim 2, wherein a surface on which the clamping hooks are hooked to one another is a flat surface.

4. The refrigeration appliance according to claim 2, wherein cross sections of the first and second wall clamping hooks are triangles.

5. The refrigeration appliance according to claim 2, wherein the first wall is provided with a clamping slot in front of the first wall clamping hook, to accommodate the the second wall clamping hook.

6. The refrigeration appliance according to claim 1, wherein the first wall is clamped with the second wall by using a clamping slot and a clamping block disposed in the clamping slot.

7. The refrigeration appliance according to claim 1, wherein the door is articulated to the case body; and further comprising an outer door pivotally connected to the door, to close the through hole of the door.

8. A refrigeration appliance, comprising:

a case body and a door connected to the case body;

the door having a doorframe, a container connected to the back of the doorframe, and a foamed heat insulation material between the doorframe and the container;

the door being formed with a through hole that extends in a front-to-rear direction;

the doorframe having a first wall facing the through hole, the container having a second wall facing the through hole, and the first wall and the second wall being superposed and clamped to form an inner wall of the through hole the first wall having a groove formed therein on a through hole facing side of the first wall, the groove defining a shoulder facing a free end of the second wall, and the free end abutting against the shoulder.

9. A refrigeration appliance, comprising:

a case body and a door connected to the case body;

the door having a doorframe, a container connected to the back of the doorframe, and a foamed heat insulation material between the doorframe and the container;

the door being formed with a through hole that extends in a front-to-rear direction;

the doorframe having a first wall facing the through hole, the container having a second wall facing the through hole, and the first wall and the second wall being superposed and clamped to form an inner wall of the through hole, the doorframe being formed with a groove having an opening facing the container, and a sealing member for sealing between the doorframe and the container being clamped in the groove.

10. The refrigeration appliance according to claim 9, wherein the doorframe is formed with the groove on each edge of the through hole.

11. The refrigeration appliance according to claim 10, wherein the grooves, on the edges of the through hole of the doorframe are connected end to end to form an annular shape surrounding the through hole.

12. The refrigeration appliance according to claim 10, wherein along a length or width direction of the door, the groove is closer to an edge of the door than the first wall.

* * * * *